US011859522B2

(12) United States Patent
Giari et al.

(10) Patent No.: US 11,859,522 B2
(45) Date of Patent: Jan. 2, 2024

(54) VENTILATION/LUBRICATION SYSTEM OF THE CRANK CHAMBER OF AN INTERNAL COMBUSTION ENGINE, IN PARTICULAR FOR VEHICLES WITH A RIDEABLE SADDLE

(71) Applicant: Piaggio & C. S.p.A., Pontedera (IT)

(72) Inventors: Francesco Giari, Pontedera (IT); Marcello Fiaccavento, Pontedera (IT)

(73) Assignee: PIAGGIO & C. S.P.A., Pontedera (IT)

( * ) Notice: Subject to any disclaimer, the term of this patent is extended or adjusted under 35 U.S.C. 154(b) by 0 days.

(21) Appl. No.: 17/907,649

(22) PCT Filed: Mar. 30, 2021

(86) PCT No.: PCT/IB2021/052621
§ 371 (c)(1),
(2) Date: Sep. 28, 2022

(87) PCT Pub. No.: WO2021/198905
PCT Pub. Date: Oct. 7, 2021

(65) Prior Publication Data

US 2023/0220792 A1 Jul. 13, 2023

(30) Foreign Application Priority Data

Mar. 30, 2020 (IT) ..... 102020000006601

(51) Int. Cl.
*F01M 13/00* (2006.01)
*F01M 11/00* (2006.01)

(52) U.S. Cl.
CPC ..... *F01M 13/0011* (2013.01); *F01M 11/0004* (2013.01); *F01M 2011/0033* (2013.01);
(Continued)

(58) Field of Classification Search
CPC ..... F01M 13/0011; F01M 11/0004; F01M 2011/0033; F01M 2011/0045; F01M 2013/0038
See application file for complete search history.

(56) References Cited

U.S. PATENT DOCUMENTS 4,590,897 A 5/1986 Hundertmark
2002/0129782 A1* 9/2002 Kawamoto ..... F01L 1/047 123/90.31
2017/0101908 A1* 4/2017 Kutsuna ..... F01M 1/04

FOREIGN PATENT DOCUMENTS

DE 10043795 A1 3/2002
DE 102017219702 B3 11/2018
(Continued)

OTHER PUBLICATIONS

Patent Cooperation Treaty, International Search Report and Written Opinion for International Application No. PCT/IB2021/052621, dated Jul. 12, 2021, 16 pages.

*Primary Examiner* — Syed O Hasan
(74) *Attorney, Agent, or Firm* — Stetina Brunda Garred & Brucker

(57) ABSTRACT

A lubrication system for internal combustion engines, in particular for vehicles with a rideable saddle, said system comprising a crank chamber in which at least one connecting rod is accommodated, and a basin or pan for collecting a lubricating liquid, wherein said crank chamber and said collection basin or pan are put in mutual communication by means of a first opening obtained in said crank chamber, wherein the flow of said lubricating liquid through said first opening from said crank chamber into said basin is adjusted by means of a first adjusting element adapted to be switched to an open position so as to allow the discharge of said lubricating liquid from said crank chamber into said collec-
(Continued)

tion basin or pan at a predetermined switching gas pressure value inside said crank chamber.

8 Claims, 7 Drawing Sheets

(52) U.S. Cl.
CPC ..... *F01M 2011/0045* (2013.01); *F01M 2013/0038* (2013.01)

(56) References Cited

FOREIGN PATENT DOCUMENTS

| | | | | |
|---|---|---|---|---|
| EP | 2305973 | A1 | | 4/2011 |
| EP | 2492461 | A1 | | 8/2012 |
| EP | 2690275 | A1 | | 1/2014 |
| JP | 2016196864 | A | * | 11/2016 |
| JP | 2016196864 | A | | 11/2016 |

* cited by examiner

VENTILATION/LUBRICATION SYSTEM OF THE CRANK CHAMBER OF AN INTERNAL COMBUSTION ENGINE, IN PARTICULAR FOR VEHICLES WITH A RIDEABLE SADDLE

CROSS-REFERENCE TO RELATED APPLICATIONS

This application claims priority to PCT International Application No. PCT/IB2021/052621 filed on Mar. 30, 2021, which application claims priority to Italian Patent Application No. 102020000006601 filed on Mar. 30, 2020, the entire disclosures of which are expressly incorporated herein by reference.

STATEMENT RE: FEDERALLY SPONSORED RESEARCH/DEVELOPMENT

Not Applicable

DESCRIPTION

Field of the Invention

The present invention belongs to the field of manufacturing internal combustion engines, for example of the multi-cylinder type with poppet valves, but also of the single-cylinder type, in particular for vehicles with a rideable saddle, this term being generally intended to mean a motor cycle or a motor vehicle with two, three or four wheels, mainly intended for the transport of people. In particular, the present invention relates to the field of manufacturing an engine of the aforesaid type provided with a ventilation and/or lubrication system for lubricating linkages and/or gears accommodated in the crank chamber and actuated (in particular, rotated) by the movement of the one or more pistons.

Background Art

As is known, an internal combustion engine, for example for a vehicle with a rideable saddle, comprises a drive shaft, the rotation of which is caused by the movement of the pistons in the combustion chambers of the respective cylinders. The transformation of the reciprocating translating motion of the one or more pistons is particularly obtained by means of linkages interposed between the pistons and the drive shaft such as for example connecting rods or the like, said linkages being accommodated in the crank chamber.

Thus, the need is felt to suitably lubricate said linkages in the crank chamber, wherein various solutions have been implemented in the past for that purpose, such as for example the so-called "wet crankcase" and "dry crankcase".

In particular, the lubricating oil in the "wet crankcase" solutions of the known type is drawn from the collecting and accumulation pan and introduced into the crank chamber or crankcase through the hydraulic circuit (including pump, valves, etc . . . ), wherein the oil accumulated in the crank chamber is cyclically discharged into the pan. For this purpose, the crank chamber and pan are put in communication by means of a flexible reed valve, said valve being therefore adapted to be switched to open position if subjected to adequate pressure. Said pressure is particularly generated both by the oil accumulated in the chamber and by the introduction of gas into the crank chamber, e.g. of the blow-by gases. Therefore, it arises that the increase in the gas pressure in the crank chamber up to a predetermined value (function of the flexibility of the reed) translates into the switching of the reed to open position, and therefore into the discharge into the pan of the oil accumulated in the crank chamber.

Although the known solutions of the "wet crankcase" type summarized above may be appreciated from various viewpoints, such as for example lubrication reliability and efficiency, construction and/or implementation simplicity and all in all low production costs, they are not entirely free from problems and/or disadvantages which the Applicant intends overcoming, or at least reducing by means of the present invention.

A first disadvantage of the known solutions of the "wet crankcase" type relates to the low frequency with which the oil accumulated in the crank chamber is discharged into the pan, the discharge frequency—corresponding to the frequency with which the reed is switched to open position—being inversely proportionate to the free volume in the crank chamber, and i.e. to the volume not occupied by the linkages to be lubricated; the greater the free volume, the greater the time required for the gas pressure in the crank chamber to reach the "switching" value at which the reed is switched to open position, and therefore the lower the discharge frequency will be.

The low discharge frequency of the oil obviously further translates into an excess of accumulated oil in the crank chamber, with the risk of the drive shaft interfering with the accumulated oil, and with the further risk for the accumulated oil to be subject to drifting phenomena during the movement of the vehicle, in particular in a bend, thus even compromising stability (due to the effect of the movement of the center of gravity).

Solutions of the "wet crankcase" type according to the prior art are known from documents EP 2305973, EP 2492461, and EP 2690275.

OBJECTS OF THE PRESENT INVENTION

It is the main task of the present invention to provide a ventilation and/or lubrication system of the crank chamber, in particular for internal combustion engines, e.g. of the multi-cylinder type with poppet valves, but also of the single-cylinder type, in particular for vehicles with a rideable saddle, which allows overcoming, or at least minimizing, the drawbacks indicated above and affecting the known systems, in particular but not only of the "wet crankcase" type. Therefore, within the scope of this task, it is a first object of the present invention to transform a system of the "wet crankcase" type into a system of the "dry crankcase" type, or at least to provide a system the functionality of which is as similar as possible to that of a system of the "dry crankcase" type.

Moreover, it is not the last object of the present invention to provide a system in which the solutions ensuring the desired advantages summarized above are easy to manufacture and/or implement at competitive costs.

DETAILED DESCRIPTION OF THE PRESENT INVENTION

The present invention arises from the general consideration that the objects summarized above may be effectively achieved by introducing an additional volume of air into the crank chamber (in addition to the blow-by ones, for example) to avoid a vacuum in the crank chamber during the compression step, which would worsen engine performance.

Moreover, this additional volume of air in the crank chamber decreases the time required for the pressure in the crank chamber to reach the minimum switching value required to switch the discharge reed from the closed position to the open one, thereby increasing the switching frequency of the reed, and therefore the discharge frequency of the lubricating oil.

The present invention further arises from the further consideration that the objects summarized above may also be achieved by reducing the free inner volume of the crank chamber, wherein the term free inner volume means the inner volume of the crank chamber not occupied by the linkages and/or gears dedicated to rotating the drive shaft.

Indeed, by reducing the free inner volume of the crank chamber, the time required for the pressure in the crank chamber to reach the minimum switching value required to switch the reed from the closed position to the open one is decreased, thereby increasing the switching frequency of the reed, and therefore the discharge frequency of the lubricating oil.

Based on the above considerations, and in order to overcome the drawbacks affecting the lubricating devices of the known type and/or to achieve the further objects summarized above, the present invention relates to an internal combustion engine, in particular for vehicles with a rideable saddle according to one of claims 1 to 7, as well as to a vehicle according to claim 8.

The present Application further describes a lubrication system for internal combustion engines, in particular for vehicles with a rideable saddle, said system comprising a crank chamber in which at least one connecting rod is accommodated, and a basin or pan for collecting a lubricating liquid, wherein said crank chamber and said collection basin or pan are put in mutual communication by means of a first opening obtained in said crank chamber, wherein the flow of said lubricating liquid through said first opening from said crank chamber into said basin is adjusted by means of a first adjusting element adapted to be switched to an open position so as to allow the discharge of said lubricating liquid from said crank chamber into said collection basin or pan at a predetermined switching gas pressure value in said crank chamber, wherein said system comprises a fixed insert accommodated inside said crank chamber, and wherein said first predetermined switching gas pressure value in said crank chamber is reached in the presence of a volume of lubricating liquid which is less than the volume of lubricating liquid in the presence of which said predetermined pressure value would be reached in the absence of said fixed insert.

According to an embodiment as disclosed, the difference between the volume of lubricating liquid in the presence of which said predetermined pressure value would be reached in the absence of said fixed insert and the volume of lubricating liquid in the presence of which said predetermined pressure value is actually reached substantially is equal to the difference between the free inner volume of said crank chamber and the volume of said fixed insert.

According to an embodiment as disclosed, said crank chamber is shaped so as to define a collection and drainage sump for and of said lubricating liquid, wherein said first opening is obtained at the bottom of said collection and drainage sump.

According to an embodiment as disclosed, said fixed insert is positioned at said collection and drainage sump, at least partially in the projection of said first opening.

According to an embodiment as disclosed, said fixed insert is positioned and shaped so as to define a conveying channel for conveying said lubricating liquid into said collection and drainage sump.

According to an embodiment as disclosed, the volume of said fixed insert is between 20% and 70%, preferably between 35% and 55% of the free inner volume of said crank chamber.

According to an embodiment as disclosed, said first switching element comprises a first flexible reed which is switchable by bending to said open position.

According to an embodiment as disclosed, said crank chamber is put in communication with the exterior by means of a second opening obtained in said crank chamber, the system comprising a second adjusting element which is switchable to an open position in which it allows the introduction of pressurized gas into said crank chamber through said second opening.

According to an embodiment as disclosed, said second switching element comprises a second flexible reed which is switchable by bending to said open position when subjected to a gas pressure having predetermined value.

According to an embodiment as disclosed, said second opening is obtained in a compartment into which an introduction channel in communication with the exterior of said compartment leads for introducing said pressurized gas into said compartment.

According to an embodiment as disclosed, said introduction channel is adapted to be put in communication with an HPC (High Pressure Cooled) system for generating said pressurized gas.

According to an embodiment as disclosed, said second opening and said introduction channel are put in mutual communication with said second flexible reed in said open position.

Further disclosed in the present Application is an internal combustion engine for a motor vehicle having a ridable seat, comprising a drive shaft and at least one connecting rod adapted to transform the combustion energy into the rotation of said drive shaft, wherein said engine comprises a lubrication system according to one of the embodiments of the present invention, and wherein said at least one connecting rod of said engine is accommodated in the crank chamber of said lubrication system.

A vehicle with a rideable saddle including an engine according to the above embodiment also is the subject of the present Application.

BRIEF DESCRIPTION OF THE DRAWINGS

The present invention is further clarified below by means of the detailed description of the embodiments depicted in the drawings. However, the present invention is not limited to the embodiments described below and depicted in the drawings; on the contrary, all those variants of the embodiments described below and depicted in the accompanying drawings, which will be obvious to those skilled in the art, fall within the scope of the present invention.

In the drawings.

DETAILED DESCRIPTION OF THE PRESENT INVENTION

The present invention finds particularly advantageous application when implemented in internal combustion engines, both of multi-cylinder type and single-cylinder type, for example with poppet valves, in particular for vehicles with a rideable saddle, this being the reason why the present invention will be described below with possible particular reference to engines of the aforesaid type.

The possible applications of the present invention however are not limited to engines of the aforesaid type alone, the present invention on the contrary being suitable to be used and implemented in all cases in which the effective and reliable lubrication of linkages is required, such as for example in the case of air compressors.

Figure 1B:
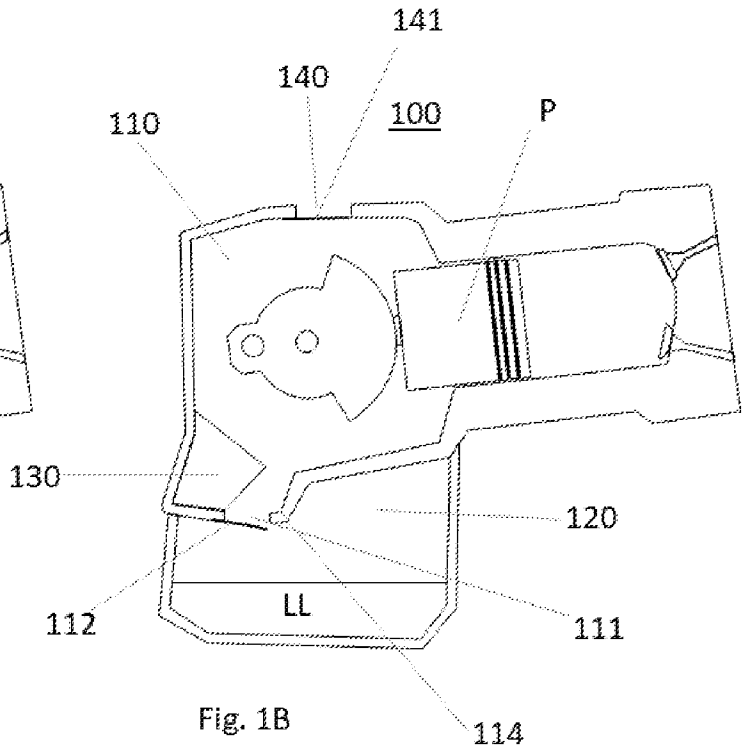
FIGS. 1*a* and 1*b* show diagrammatic cross-sectional views of a system according to an embodiment of the present invention, in two different operating circumstances.
Figure 1A:
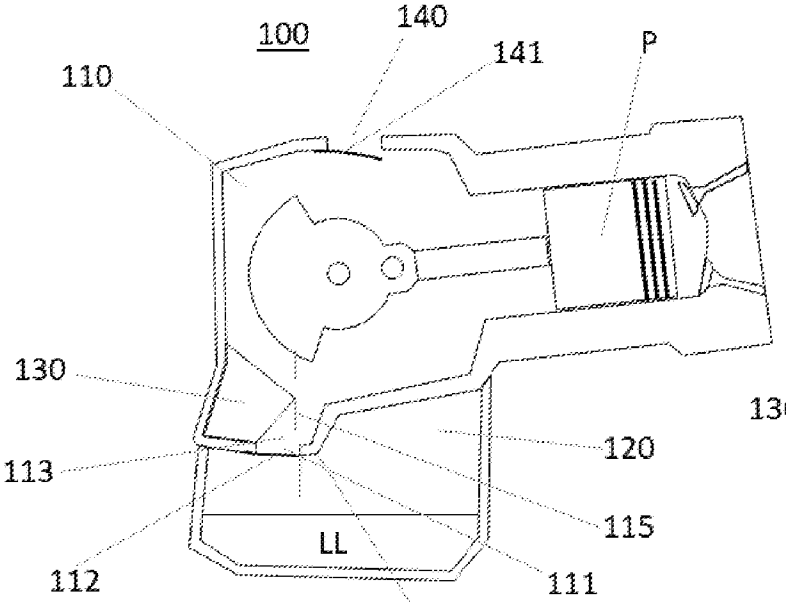
Figure 2:
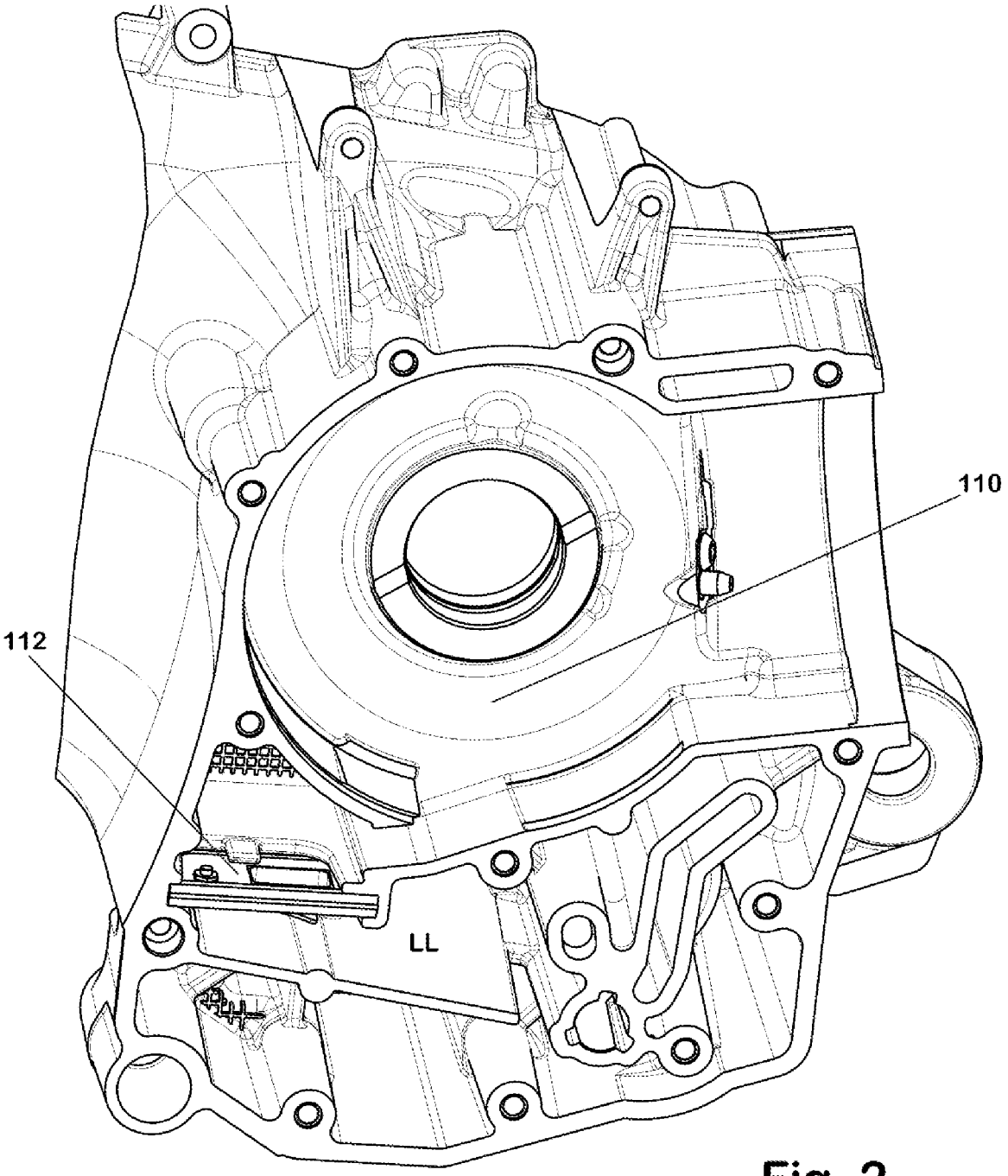
FIGS. 2 and 3 show perspective and partial sectional views of a system according to an embodiment of the present invention.
Figure 3:
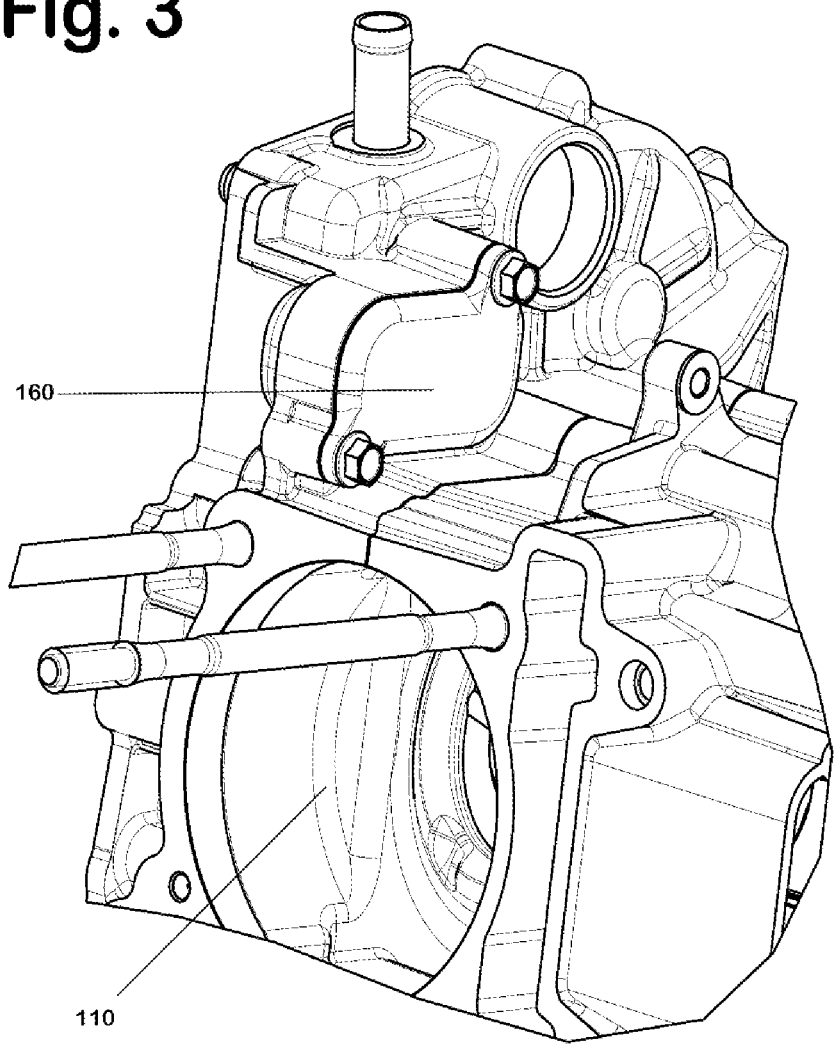
Figure 4:
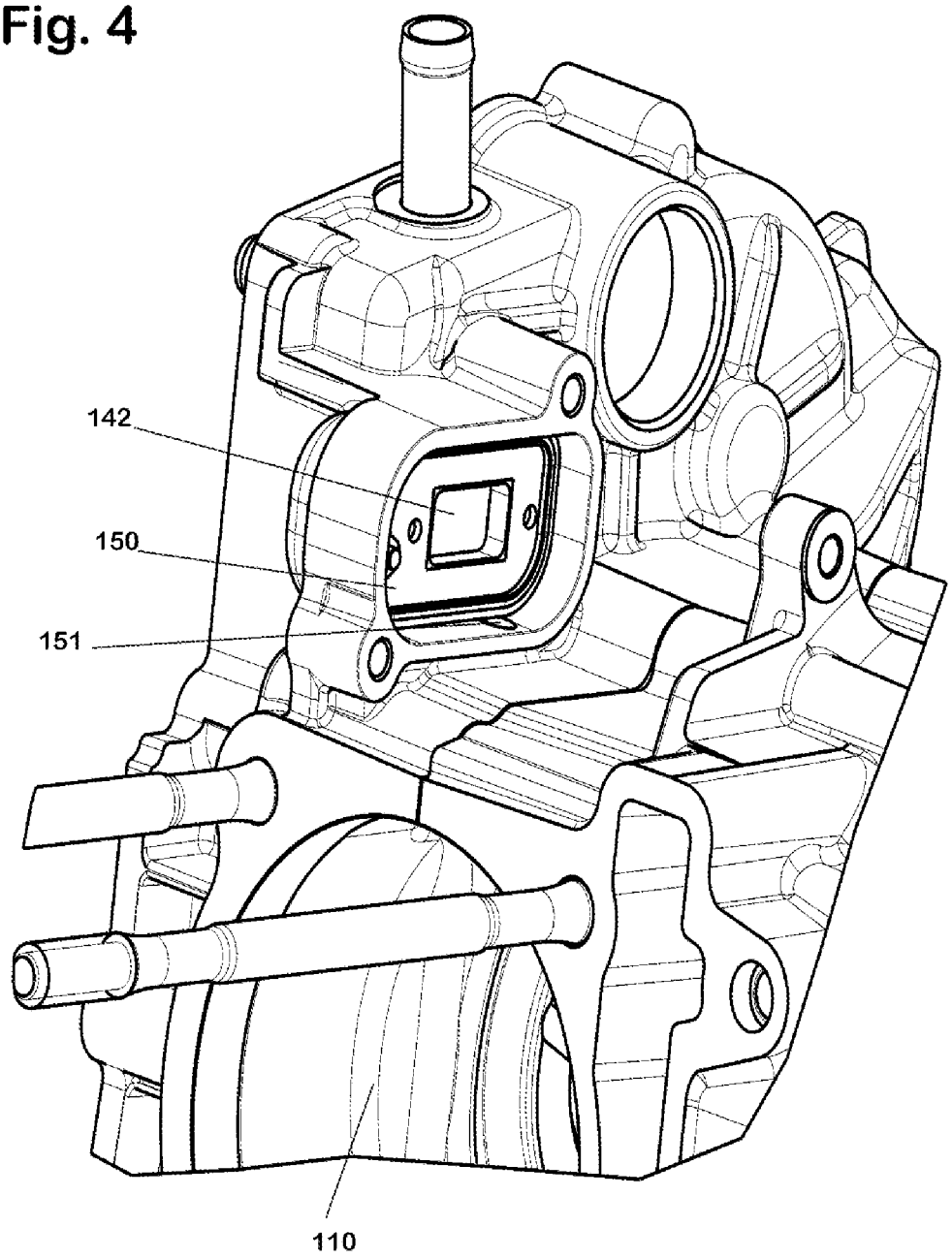
FIGS. 4 to 7 each show a perspective, possibly partial sectional, view of a system according to an embodiment of the present invention.
Figure 5:
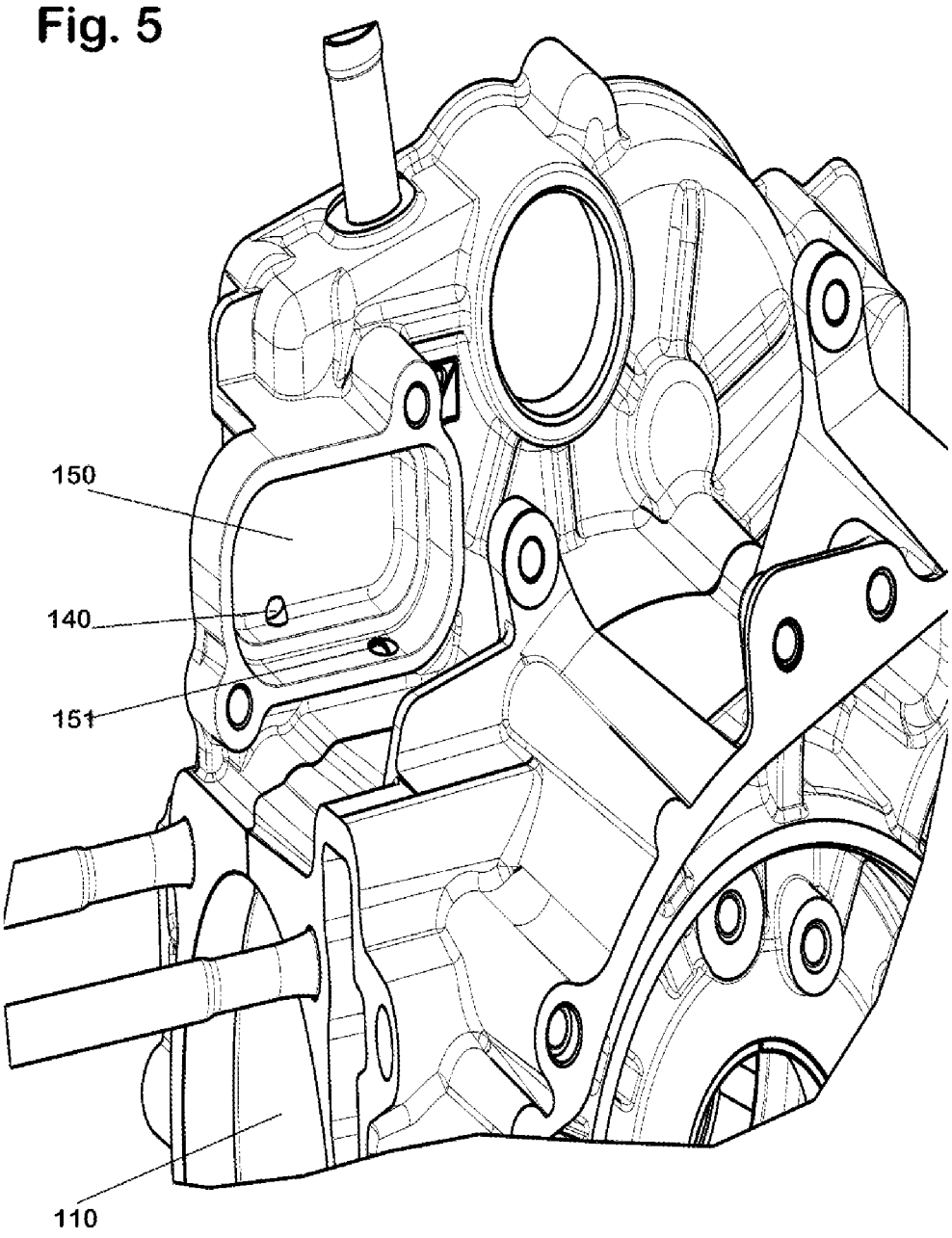

System 100 depicted according to the embodiment in FIGS. 1 to 3 comprises a crank chamber 110, a basin or pan 120 for collecting a lubricating liquid (e.g. oil) LL, wherein the crank chamber 110 communicates with a cylinder in which a piston P is accommodated, the reciprocating translating motion of which, generated by the combustion of fuel, is transformed into the rotation motion of the drive shaft by means of linkages accommodated in the crank chamber 110 and not depicted in the drawings both because they differ according to the types of engine and because they are not essential for the purposes of the present invention; by way of example and for completeness of description, said linkages may comprise one or more connecting rods or similar components.

The crank chamber 110 and pan or basin 120 are put in mutual communication by an opening 111 obtained at the bottom of chamber 110, in particular in the lowest part of the bottom of chamber 110, in detail at bottom 114 of an accumulation sump 113. Moreover, an adjustment element (of the flow of lubricating liquid from chamber 110 into pan 120, see the following description) is positioned at opening 111, practically a reed valve (with flexible reed) 112 adapted to be switched between a closed position (not depicted) in which it closes opening 111, thus preventing the flow of lubricating liquid LL from chamber 110 into pan 120, and the open position in FIG. 1, in which the flow of lubricating liquid LL from chamber 110 to pan 120 may be possible instead. Practically, the operating modes of system 100 in FIGS. 1 to 3, partially corresponding to the operating modes of systems according to the prior art, may be summarized as follows.

The lubricating oil LL is drawn from the collecting and accumulation pan 120 and introduced into the crank chamber or crankcase 110 through the hydraulic circuit (not depicted and including pump, valves, etc . . . ); moreover, the reciprocating translating motion of piston P translates into the introduction of pressurized gas into chamber 110, which prevents the chamber 110 itself from having a pressure drop during the rising movement of piston P. The lubricating oil LL repeatedly introduced (in substantially continuous manner) into chamber 110 accumulates on the bottom of chamber 110, in particular at least partially in the accumulation sump 113, to be cyclically discharged into pan 120 through opening 111. Indeed, as the pressure in chamber 110 rises, the flexible reed (for example made of PVC) 112 is subjected to increasing pressure up to bending (switching from the closed position in FIG. 1*a* to the open position in FIG. 1*b*) at a predetermined pressure value (inversely proportionate to the flexibility of reed 112), thereby opening the opening 111 and allowing the discharge of oil LL and of the gases from chamber 110 to pan 120.

However, as mentioned, system 100 according to the present invention comprises peculiarities aiming to increase the frequency with which the mixture of lubricating oil LL and gas in chamber 110 is discharged into pan 120. Indeed, numeral 140 in the drawings identifies a further opening obtained in the outer wall of the crank chamber 110; as in the case of opening 111, opening 140 is provided with a reed valve (having flexible reed) 141 adapted to be switched by bending between a closed position (FIG. 1*b*, in which it closes opening 140) and an open position (FIG. 1*a*) in which it frees opening 140, thus allowing the introduction of pressurized gas into the crank chamber 110. Obviously, the introduction of pressurized gas (e.g. air) into chamber 110 in addition to the blow-by gases or originating from another source, reduces the time required for the switching pressure of the reed valve 112 to be reached in chamber 110, whereby: the time is reduced between two successive switching operations (both in open position) of reed 112; the switching frequency of reed 112 is increased; the amount of lubricating liquid LL which can be accumulated in chamber 110 between two successive switching operations of reed 112 is reduced.

The interior of the crank chamber 110 is put in communication by means of a circuit which leads into opening 140, with a further zone of said internal combustion engine, in particular with a source of air inside the engine, for example with an HPC (High Pressure Cooled) system.

Depending on the source of air, or more generally pressurized gas, an amount of gas (e.g. air) in a grater order of magnitude than that of the blow-by gases may be introduced, in the time unit, into the crank chamber 110.

In the embodiment in FIGS. 3 to 7, the second reed 141 is accommodated in a compartment 150 (closed by means of a removable cover 160) into which an introduction channel 151 in communication with the exterior of said compartment 150 for introducing said pressurized gas into said compartment 150, and a second channel 170 lead, the latter defining the opening 140, wherein the interior of compartment 150 is put in communication with the interior of the crank chamber 110 by means of channel 170.

Figure 6:
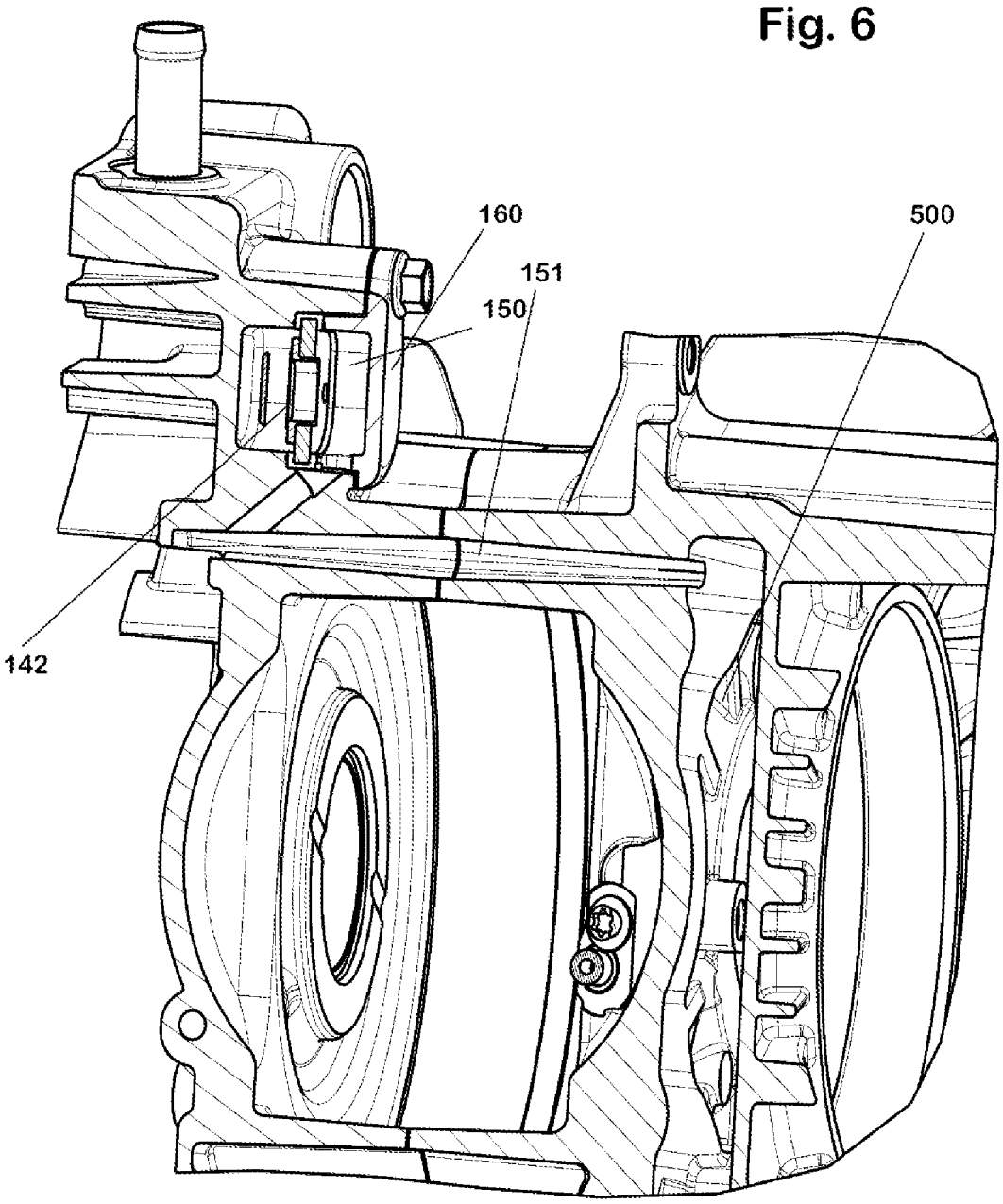
Figure 7:
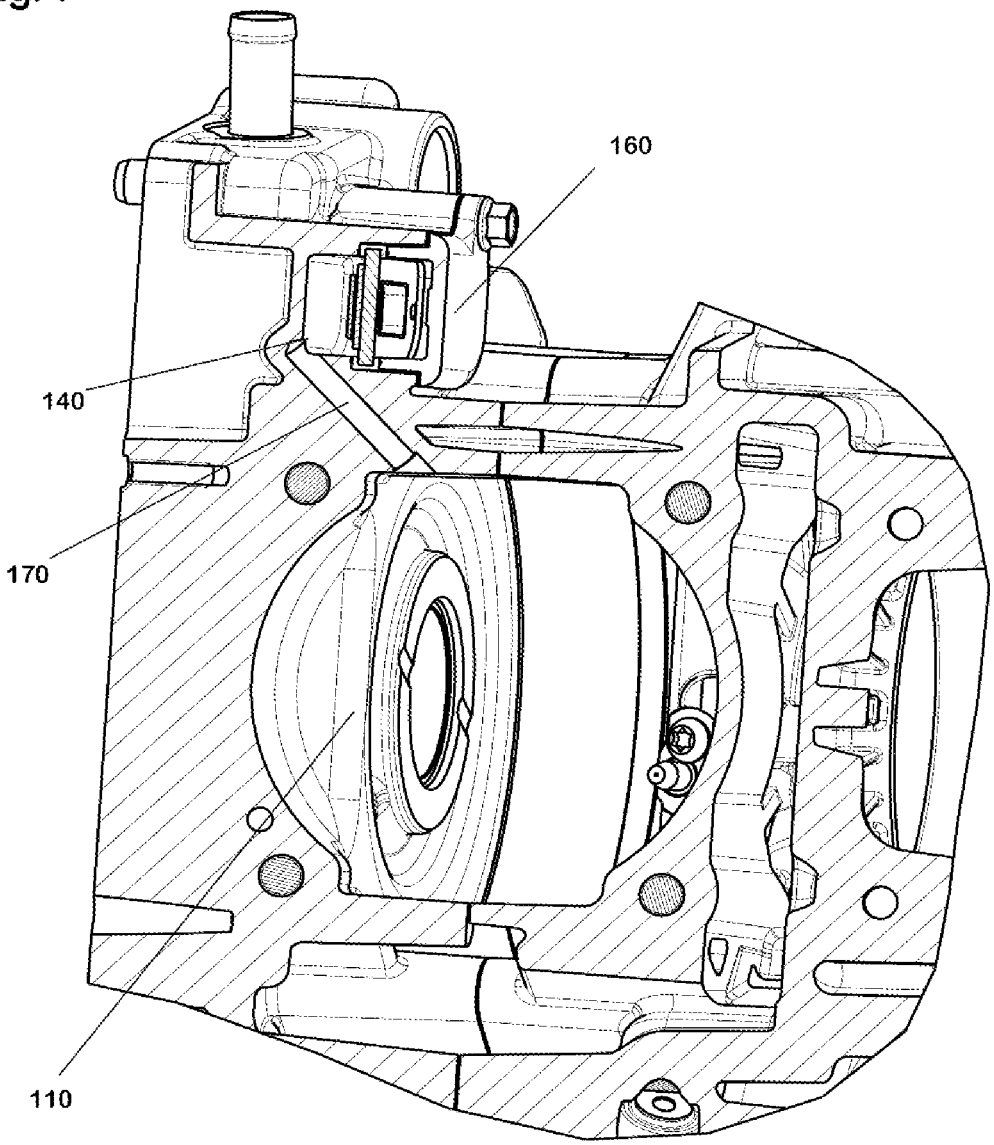

In the embodiment depicted in FIGS. 6 and 7, the interior of compartment 150 is put in communication with the chain compartment and/or the flywheel cover compartment 500 of the engine by means of channel 151, said chain compartment and/or flywheel cover compartment in turn being in communication with the oil pan 120, wherein a closed recirculation of air is thus generated from pan 120 into the crank chamber 110 without the need to draw on air or gas from the exterior; indeed, the flow of air generated by said moving chain and/or flywheel compartments is introduced into compartment 150, wherein in the closed position reed 141 separates compartment 150 into a first half-compartment into which channel 151 leads and a second half-compartment into which channel 170 leads.

The closed recirculation of air which occurs from pan 120 into the crank chamber 110 and the chain and/or flywheel compartments allows the flow of air ejected from the blow-by valve to be limited, therefore limiting the ejection of oil-enriched vapors and fumes, and thus reducing the consumption of oil.

Indeed, by drawing air from the exterior of the engine, it is noted how such an amount of air is to be then ejected through the blow-by valve. In particular, it is found that by drawing fresh air from the exterior, the flow of ejected air with respect to an internal recirculation is about four times greater. Such an increased outlet flow generates:

increased fumes and vapors;

such fumes and vapors being oily vapors which therefore contain oil from cleaning the crank chamber. Therefore, there is an increased consumption of oil with the ejection of such vapors.

In the above-mentioned solution, channel 151 causes a closed recirculation of air in which the air is drawn internally from the chain and/or flywheel compartments. This causes an air exchange between two closed internal volumes. Therefore, the air does not originate from the exterior, rather is recirculated from the interior.

This solution allows obtaining an effective cleaning of the crank chamber, as described above, thus reducing the temperature of the oil which remains in the crank chamber for less time, it being ejected more frequently by means of reed 141, by virtue of the overpressure obtained with the introduction of air. This is due to the increase in the average pressure in the crank chamber, which promotes the disposal of the oil and therefore prevents grinding effects which cause power losses and high temperatures.

Additionally, such a solution allows the flow of air ejected outside by means of the blow-by valve to be limited, thus accordingly reducing the fumes and vapors and the consumption of oil itself. As it is an internal air recirculation, the flow ejected outside is less than the amount of air introduced from the exterior; this results in a reduction of fumes and vapors and accordingly, in a reduction of the consumption of oil.

Then, and in particular when the pressure of the air in the compartment 150 reaches the switching value of reed 141, the switching of the reed 141 to open position results in the mutual communication of the channels 151 and 170, and therefore in the introduction of air from the HPC system and/or from the chain compartment and/or from the flywheel compartment into the crank chamber 110, with the effects explained above of the increase in switching frequency of reed 112.

Further peculiarities of the system according to the present invention are described below with reference to FIGS. 1 to 7.

As depicted, a fixed insert 130 is accommodated in chamber 110 in order to decrease the free inner volume (not occupied by movable linkages) of the crank chamber 110. Said insert 130 has a trapezoidal cross section (according to a plane parallel to the plane on which the connecting rod moves, and therefore perpendicular to the rotation axis of the drive shaft) and is located at sump 113, at a predetermined distance from bottom 114 thereof (so as not to hinder the accumulation of oil LL in sump 113), in particular at least partially in the projection of opening 111 (shown by a dashed line) and so as to define a conveying channel 115 for conveying said lubricating liquid LL into said collection and drainage sump 113.

Due to insert 110, the predetermined gas pressure value at which reed 112 switches by bending from the closed position to the open one (hereinafter also defined switching pressure value) is reached inside said crank chamber 110 in the presence of a volume of lubricating liquid LL which is less than the volume of lubricating liquid LL in the presence of which said predetermined gas pressure value would be reached in the absence of said fixed insert 130, wherein obviously the decrease of the amount of oil needed to reach the switching gas pressure results in more frequent switching of reed 112 (or in other words, in an increase in the switching frequency), and therefore in a decrease in the amount of liquid LL accumulated between two successive switching operations (both from the closed position to the open one) of the flexible reed 112, wherein the difference between the volume of lubricating liquid LL in the presence of which said predetermined switching pressure value would be reached in the absence of the fixed insert 130 and the volume of lubricating liquid LL in the presence of which said predetermined switching pressure value is actually reached substantially is (by virtue of insert 130) equal to the difference between the free inner volume of the crank chamber 110 and the volume of the fixed insert 130.

As mentioned, the reduction of the amount of lubricating liquid LL which can be accumulated in chamber 110 between two successive switching operations of reed 112 results in a reduction of the risk for the drive shaft to interfere with the accumulated oil, and of the further risk for the oil accumulated to be subject to drifting phenomena during the movement of the vehicle, in particular in a bend, thus even compromising the stability thereof (due to the effect of the movement of the center of gravity).

Depending on the applications, the volume of said fixed insert 130 may be between 20% and 70%, preferably between 35% and 55% of the free inner volume of the crank chamber 110.

Therefore, by the above detailed description of the embodiments of the present invention as depicted in the drawings, it has been demonstrated that the present invention allows the preset objects to be achieved, thus overcoming the drawbacks and/or disadvantages affecting the solutions according to the prior art.

For example, the present invention allows providing a ventilation and/or lubrication system, the operating modes of which are more similar to those of a "dry crankcase" than to those of a "wet crankcase", and which allows avoiding excessive accumulations of lubricating liquid at the shaft of the crank chamber for long time periods.

Although the present invention was clarified above by means of the detailed description of the embodiments depicted in the drawings, the present invention is not limited to the embodiments described above and depicted in the drawings; on the contrary, all those variants and/or modifications of the embodiments described above and depicted in the accompanying drawings which are apparent and obvious to those skilled in the art fall within the scope of the present invention.

The scope of protection of the present invention is thus defined by the claims.

The invention claimed is:

1. An internal combustion engine, of vehicles with a rideable saddle, wherein said internal combustion engine comprises a lubrication system, said system comprising a crank chamber in which at least one connecting rod is accommodated, and a basin or pan for collecting a lubricating liquid, wherein said crank chamber and said collection basin or pan are put in mutual communication by means of a first opening obtained in said crank chamber, wherein the flow of said lubricating liquid through said first opening from said crank chamber into said basin is adjusted by means of a first adjusting element adapted to be switched to an open position so as to allow the discharge of said lubricating liquid from said crank chamber into said collection basin or pan when the pressure inside said crank chamber is higher than or equal to a first predetermined pressure value; characterized in that said crank chamber is put in communication with a further zone of said internal combustion engine by means of a circuit which leads into a second opening obtained in said crank chamber, and in that it comprises a second adjusting element which is switchable to an open position in which it allows the introduction of air into said crank chamber through said second opening when the pressure inside said crank chamber is lower than or equal to a second predetermined pressure value, wherein said second opening is obtained in a compartment into which an introduction channel in fluid communication with the exterior of said compartment leads for introducing air into said compartment, and wherein said introduction channel is put in communication with a chain compartment and/or a compartment defined by the flywheel cover of said internal combustion engine, wherein a closed recirculation of air is thus generated from pan into the crank chamber without the need to draw in air or gas from the exterior.

2. The engine according to claim 1, characterized in that said second switching element comprises a first reed valve with opening threshold equal to said second predetermined pressure.

3. The engine according to claim 1, characterized in that said system comprises a fixed insert accommodated inside said crank chamber, and therefore in that said first predetermined pressure value in said crank chamber is reached in the presence of a volume of lubricating liquid which is less than the volume of lubricating liquid in the presence of which said first predetermined pressure value would be reached in the absence of said fixed insert.

4. The engine according to claim 1, characterized in that said crank chamber is shaped so as to define a collection and drainage sump for said lubricating liquid, and in that said first opening is obtained at the bottom of said collection and drainage sump.

5. The engine according to claim 1, characterized in that said first switching element comprises a second reed valve with opening threshold equal to said first predetermined pressure.

6. The engine according to claim 1, wherein said second predetermined pressure value is greater than said first predetermined pressure value.

7. The engine according to claim 3, characterized in that said fixed insert is positioned at said collection and drainage sump at least partially in the projection of said first opening.

8. A vehicle with a rideable saddle, characterized in that it comprises an engine according to claim 1.

* * * * *